US006540290B2

(12) United States Patent
Liu

(10) Patent No.: US 6,540,290 B2
(45) Date of Patent: Apr. 1, 2003

(54) FOLDING CHAIRS

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/917,939

(22) Filed: Jul. 31, 2001

(65) Prior Publication Data

US 2003/0025362 A1 Feb. 6, 2003

(51) Int. Cl.[7] ..... A47C 4/28
(52) U.S. Cl. ..... 297/45; 297/59
(58) Field of Search ..... 297/42, 44, 45, 297/56, 59

(56) References Cited

U.S. PATENT DOCUMENTS

| | | | | | |
|---|---|---|---|---|---|
| 1,729,141 | A | * | 9/1929 | Tomilson | 297/59 |
| 1,942,112 | A | * | 1/1934 | McQuilkin | 297/45 |
| 1,963,835 | A | * | 6/1934 | Deland | 297/44 |
| 2,121,100 | A | * | 6/1938 | Rosenbaum | 297/244 |
| 2,447,391 | A | * | 8/1948 | Brandes et al. | 297/45 |
| 2,485,016 | A | * | 10/1949 | Rideout | 297/45 |
| 2,493,682 | A | * | 1/1950 | Meehan | 297/45 |
| 3,730,584 | A | * | 5/1973 | Uchida | 297/45 |
| 4,245,849 | A | * | 1/1981 | Thiboutot | 280/20 |
| 4,493,488 | A | * | 1/1985 | Panaia et al. | 280/42 |
| 5,044,690 | A | * | 9/1991 | Torrey | 297/16.1 |
| 5,269,587 | A | * | 12/1993 | Cunningham et al. | 297/42 |
| 5,709,428 | A | * | 1/1998 | Hugghins | 297/16.2 |

FOREIGN PATENT DOCUMENTS

GB 2101540 A * 1/1983

* cited by examiner

*Primary Examiner*—Peter R. Brown
*Assistant Examiner*—Joseph Edell
(74) *Attorney, Agent, or Firm*—Bacon & Thomas

(57) ABSTRACT

An improved folding chair includes two side frames each having a front leg, a rear leg, and a linkage bar bridging the front leg and the rear leg, and a first loading bracket and a second loading bracket. The linkage bars are coupled respectively with a tubular rod which is turnable on the linkage bar. The tubular rods respectively attach to a first and a second toggle bar which are pivotally engaged on a toggle joint. The first and the second loading bracket have respectively a first side bar and a second side bar which are pivotally engaged with the first and the second toggle bar in a cross and staggered manner. The first and the second side bar have respectively one end engaged with each other on another toggle joint, and connect respectively to a first loading bar and a second loading bar to form a seating zone. The two side frames may be moved towards each other by an external force such that the two tubular rods are turned on the two linkage bars, and drive the first and the second toggle bar and the first and second loading bracket toward each other about the toggle joints, which function as fulcrums to juxtapose and fold the chair to a compact size.

5 Claims, 5 Drawing Sheets

FOLDING CHAIRS

BACKGROUND OF THE INVENTION

The present invention relates to improved folding chairs and particularly to a folding chair that has toggle joints to engage various elements and to function as fulcrums that allow the elements to fold closely with one another, thereby permitting the chair to be folded to a compact size.

Outdoor leisure and recreational activities are very popular these days. As many people live and work in highly competitive environments, and have accumulated a lot of tension and stress, participation in outdoor activities such as field trips, camping, or Bar-B-Q helps people to release tension and stress, and can improve quality of life. It often happens that some recreational sites do not have all the facilities required. In order to better enjoy the outdoor activities, people have to carry some outdoor articles and goods with them, especially tables and chairs. Hence to shrink the size of the tables and chairs has become an important issue to furniture producers.

Folding chairs are widely used nowadays, such as in outdoor trips, school activities, provisional meetings, etc. In the earlier days, folding chairs were mostly made of wood. As wooden chairs are heavy, they are rarely used these days.

In order to remedy the shortcomings of the folding chairs in the past, contemporary folding chairs generally adopt metal chair frames made of steel tubes, aluminum tubes or steel rods. They are bent to desired shapes, then are coupled and stitched with seat pads and backrests made of canvas or fabric. They are generally light weight and portable, and are easy to fold to small sizes for carrying. Hence they are well accepted on the market.

The aforesaid folding chairs mostly have the seat pad pivotally engaged to the backrest. After being used for a period of time, the seat pad tends to sag and cause deformation of the pivotal section. As a result, the pivotal section will not function properly, and make folding or extending of the chair difficult. It becomes an annoying problem to users.

Moreover, the seat pad and backrest usually are fixedly stitched to the chair frame. Once assembled, it is not possible to remove or separate from the chair frame. Hence when using for a period of time, the seat pad and backrest could become smeared or frayed. As the seat pad and backrest cannot be removed for washing and cleaning or replacement, the whole folding chair has to be thrown away. It is a costly waste.

SUMMARY OF THE INVENTION

The primary object of the invention is to resolve the foregoing disadvantages. The invention aims to provide an improved folding chair that has toggle joints to engage various elements and to function as fulcrums to allow the elements to be folded closely with one another for folding the chair to a compact size.

The folding chair of the invention consists of two side frames. Each side frame has a front leg and a rear leg bridged by a linkage bar. The chair also includes a first and a second loading bracket located between the side frames. The linkage bar is coupled with a turnable tubular rod. The tubular rods at two sides attach respectively to a first and a second toggle bar. The first and the second loading bracket include respectively a first and a second side bar which are pivotally engaged with the first 5 and second toggle bars, and have one end engaged with a toggle joint. The first and second side bar have respectively a first and second loading bar on the upper side to form a seating zone. When applying force on the side frames in sideward directions, the two tubular rods will turn about the linkage bars and drive the first and second toggle bar, the first and second loading brackets folding towards each other about the toggle joints so that the chair may be folded to a compact size.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
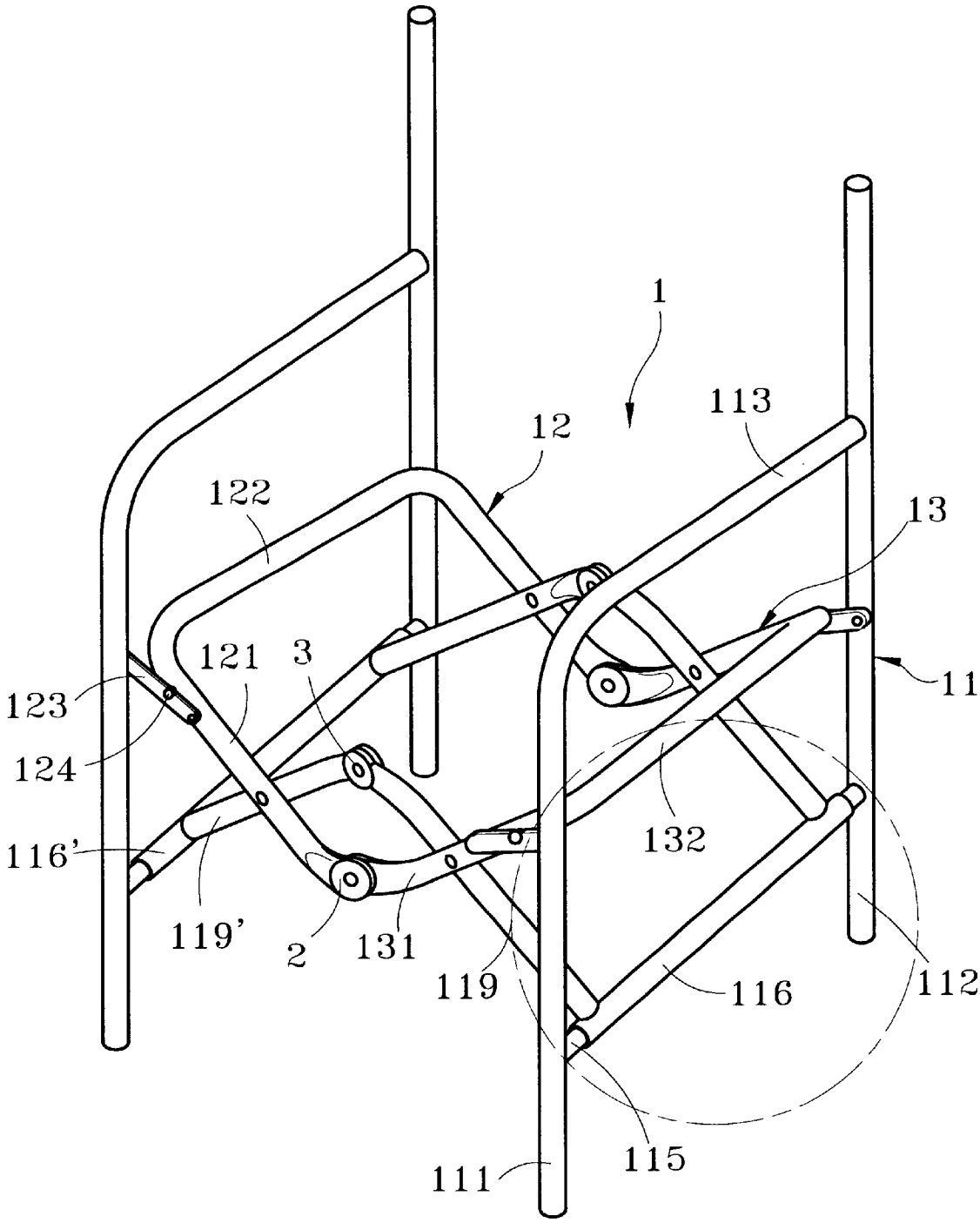
FIG. 1 is a perspective view of the invention.
Figure 2:
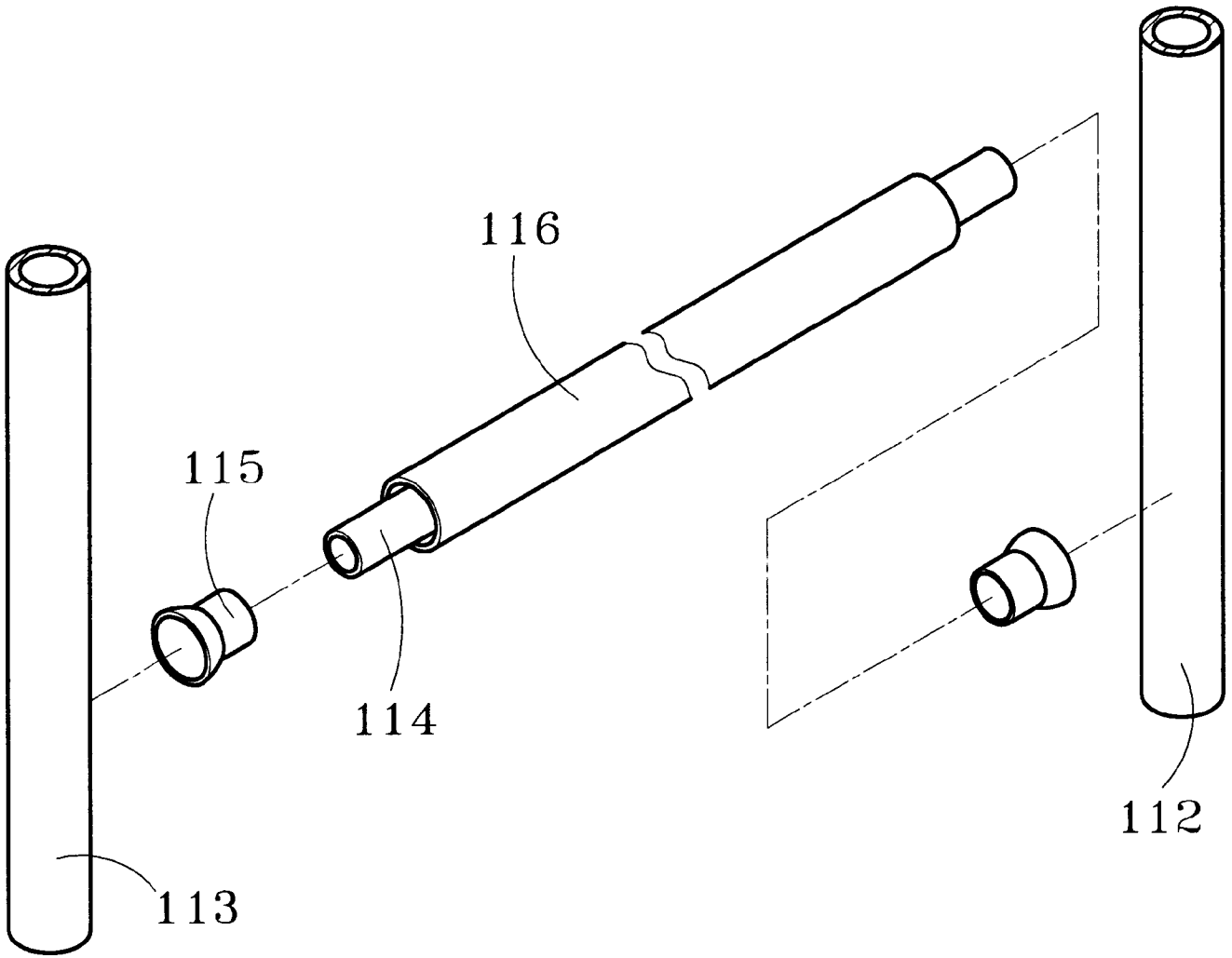
FIG. 2 is a fragmentary exploded view of the invention.
Figure 4:
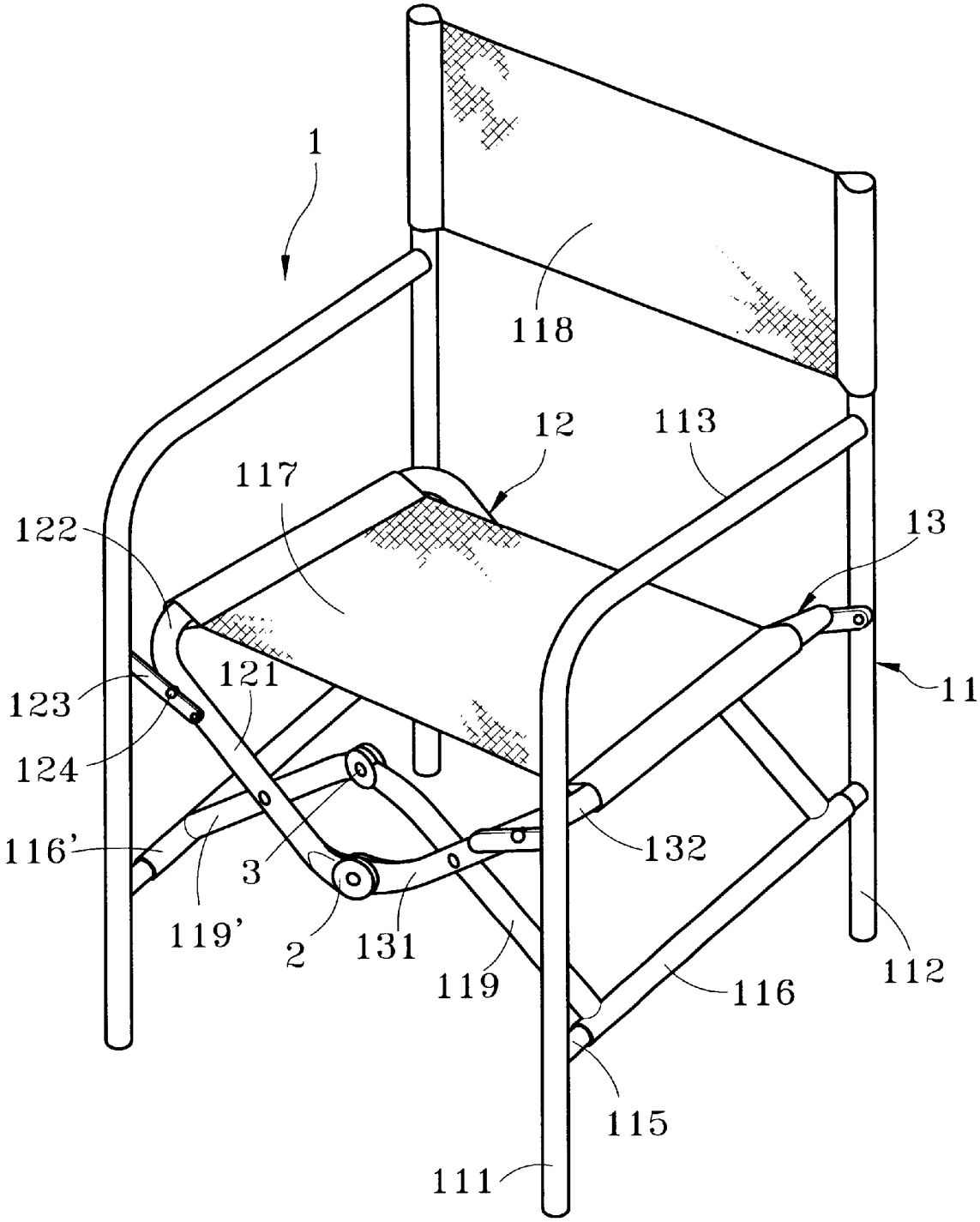
FIG. 4 is a schematic view of an embodiment of the invention.

Referring to FIGS. 1, 2, and 4, the folding chair 1 of the present invention consists of two side frames 11, a first loading bracket 12, and a second loading bracket 13. Each side frame 11 has a front leg 111, a rear leg 112, and a linkage bar 114 (FIG. 2) bridging the front and rear leg 111I and 112. The front leg 111 further is bent and extended to the rear leg 112 to form an armrest 113. The two linkage bars 114 are coupled respectively with a tubular rod 116, 116' which has an interior diameter greater than the exterior diameter of the linkage bar 114. The opposing inner sides of the front leg 111 and rear leg 112 have respectively a coupling sleeve 115 mounted thereon to engage with two ends of the linkage bar 114. The coupling sleeve 115 has an outside diameter greater than the diameter of the linkage bar. Hence the tubular rods 116, 116' are turnable on the linkage bars 114. The tubular rods 116, 116' further engage respectively with a first toggle bar 119 and a second toggle bar 119' which have another end engaged with each other on a toggle joint. The first and second loading bracket 12 and 13 have respectively a first and a second side bar 121, 131 which are pivotally engaged with the first and second toggle bar 119, 119' in a cross and staggered manner at a middle section thereof, and have respectively one end engaged with each other on another toggle joint. The first and second side bars 121, 131 further connect respectively with first and second loading bars 122, 132 at one end thereof to form a seating zone. There is a latch lever 123 located between the loading brackets 12, 13 and the front and rear leg 111, 112. The latch lever 123 has a latch notch 1231. The first and second loading bracket 12, 13 have respectively a safety latch strut 124 engageable with the latch lever 123. When the folding chair 1 is extended for use, the latch lever 123 may be engaged with the safety latch strut 124 to make the chair firm and steady without collapsing inadvertently to enhance users' safety. A seat pad 117 may be mounted on the seating zone formed by the first and second loading bars 122, 132. A backrest pad 118 may be coupled to the upper section of the rear leg 112, thus completing the construction of the folding chair 1.

Figure 3B:
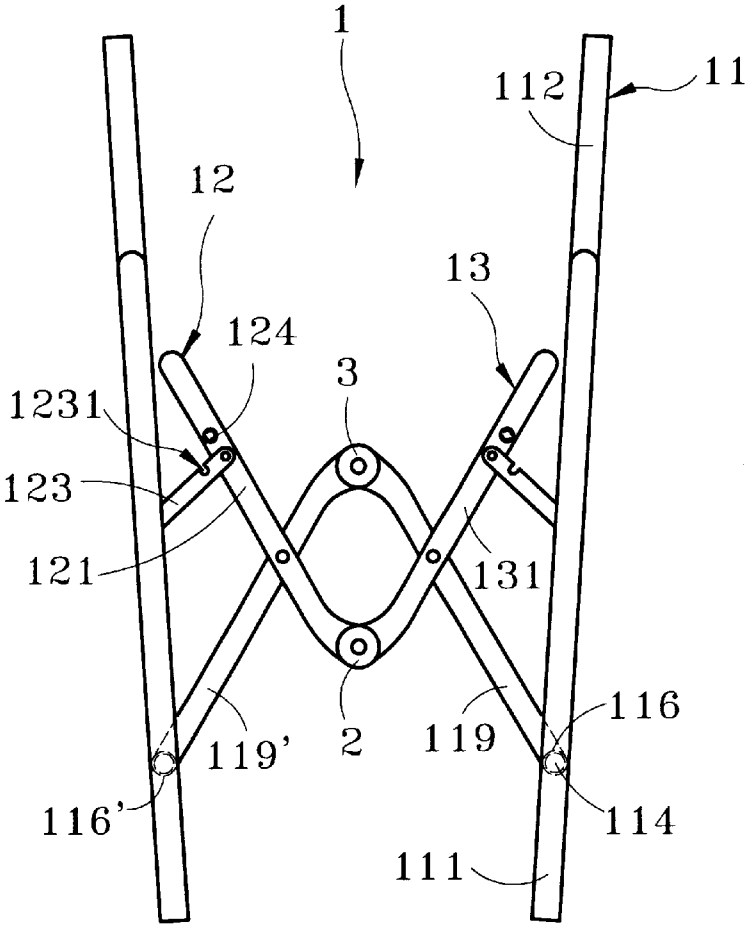
FIGS. 3A, 3B, 3C and 3D are schematic views of the invention under folding.
Figure 3A:
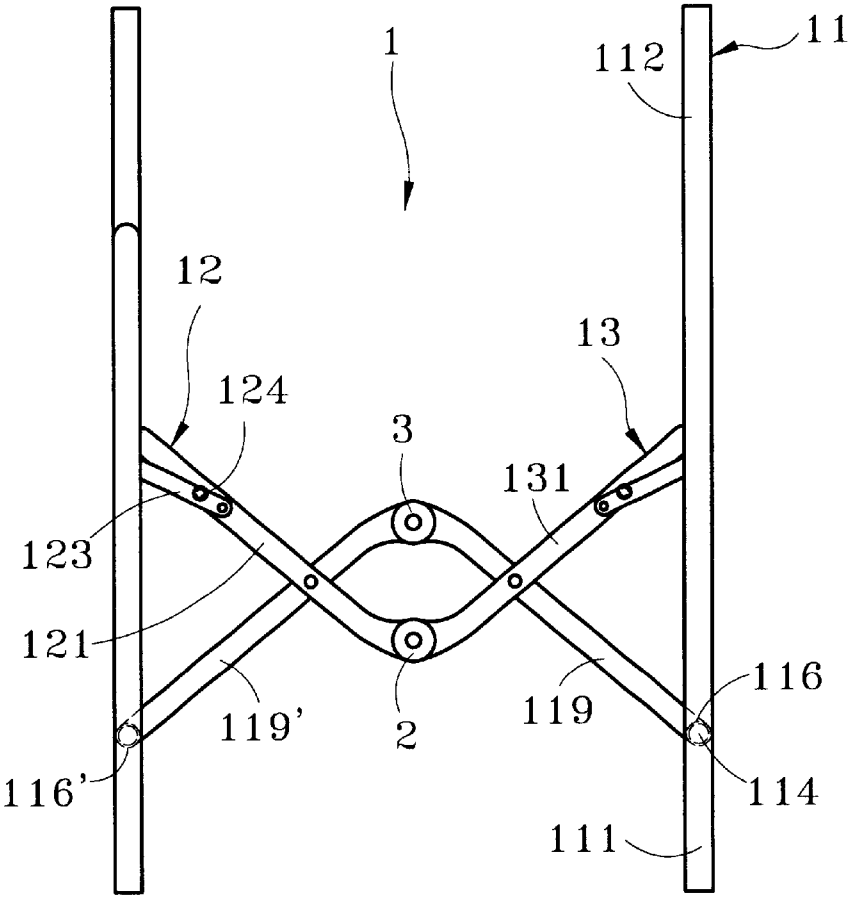
Figure 3D:
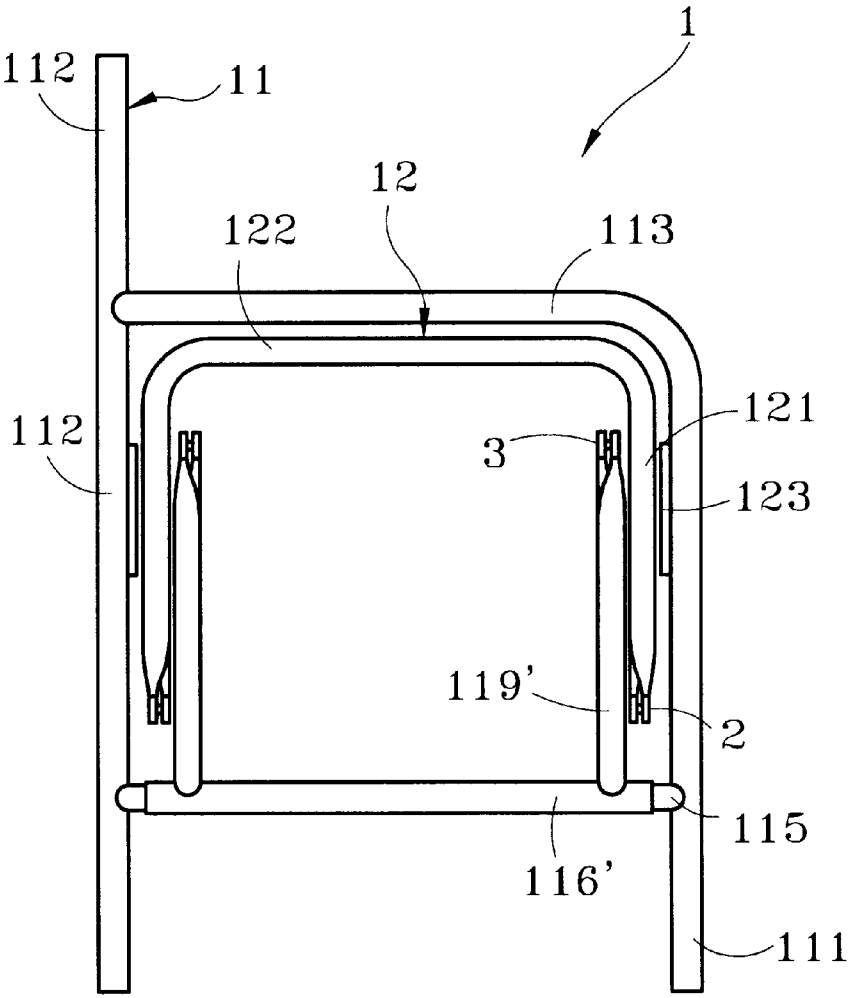
Figure 3C:
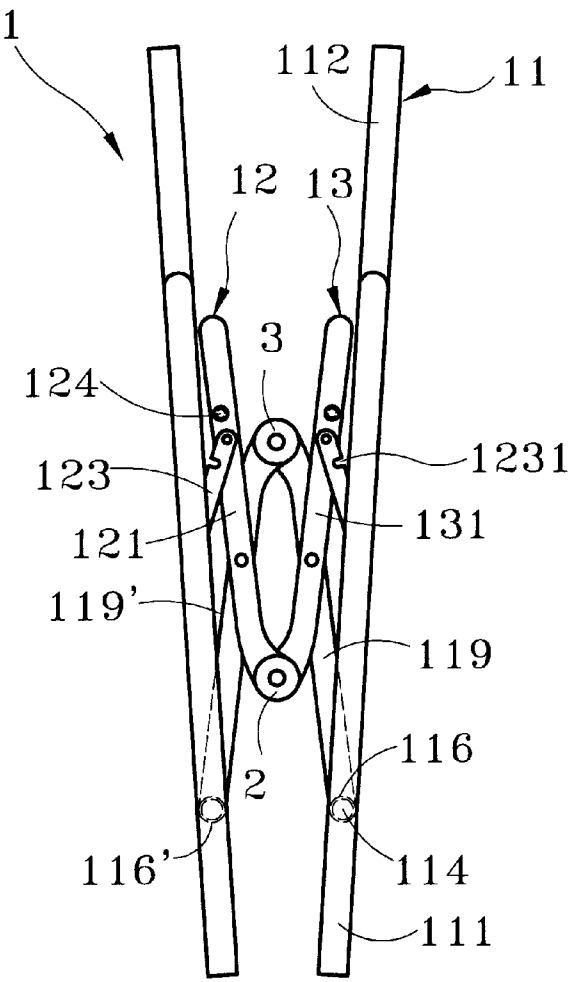

Referring to FIGS. 3A, 3B and 3C, the toggle joints of the first and second toggle bar 119, 119', and the first and second side bar 121, 131 may be covered by a first and second guarding cap 2, 3 for reducing the friction and noise of the toggle joints. This also helps to reduce the wearing of the folding elements. To fold the chair, force is applied to the side frames 11 to turn the tubular rods 116, 116' on the linkage bars 114. The latch lever 123 is disengaged from the safety latch strut 124. When the tubular rods 116, 116' turn, the toggle bars 119, 119' will be driven to move upwards at the toggle joint for a selected displacement. The pivotal axes between the first and second toggle bar 119, 119' and the first and second side bar 121, 131 of the first and second loading bracket 12, 13 will function as fulcrums. Therefore, the toggle joint of the first and second side bars 121, 131 will be moved downwards while the first and second loading bars 122, 132 will be moved upwards. As shown in FIG. 3D, when the chair is fully folded, the first and second loading bracket 12, 13 and the first and second toggle bar 119, 119' will be housed in the space bordering the armrest 113 and linkage bars 114 of the side frames 11, and the side frames 11I will be juxtaposed with each other to allow the chair 1 to be folded in a compact size.

What is claimed is:

1. An improved folding chair, comprising:

two side frames each having a front leg, a rear leg, and a linkage bar bridging the front leg and the rear leg, each said linkage bar being coupled respectively with a tubular rod which is turnable on the respective linkage bar, each tubular rod being respectively attached to a first and a second toggle bar, ends of the first aid second toggle bars being pivotally engaged to each other by a first toggle joint; and a first loading bracket and a second loading bracket having respectively a first side bar and a second side bar, said first and second side bars of the respective loading brackets being pivotally engaged with the first and the second toggle bar in a crossed and staggered manner, said first loading bracket having one end engaged with one end of said second loading bracket by a second toggle joint, and the first and the second side bars of the loading brackets connecting respectively with a first loading bar and a second loading bar to form a seating zone to which a seat may be attached;

wherein the two side frames are movable to juxtapose with each other under an external force such that the two tubular rods are turned on the two linkage bars, and the first toggle bar and the second toggle bar and the first loading bracket and the second loading bracket are moved toward each other about the respective first and second toggle joints which function as fulcrums to juxtapose and fold the chair.

2. The improved folding chair of claim 1 further having a latch lever located between the first and the second loading bracket and the front leg and the rear leg, the latch lever having a latch notch, the first and the second loading bracket having a safety latch strut for engaging with the latch lever when the folding chair is extended.

3. The improved folding chair of claim 1, wherein the toggle joint of the first and the second toggle bar is covered by a guarding cap for reducing friction and noise.

4. The improved folding chair of claim 1, wherein the toggle joint of the first and the second side bar is covered by a guarding cap for reducing friction and noise.

5. The improved folding chair of claim 1, wherein the front leg and the rear leg have respectively a coupling sleeve mounted to an opposing inner side thereof to engage with two ends of the respective linkage bars, the coupling sleeve having an exterior diameter greater than the diameter of a corresponding said linkage bar to allow the tubular rods to be turned on the two linkage bars.

* * * * *